US008499677B2

(12) United States Patent
Lee

(10) Patent No.: US 8,499,677 B2
(45) Date of Patent: Aug. 6, 2013

(54) W-SHAPED HULL

(75) Inventor: Richard Kin Ho Lee, Scarborough (CA)

(73) Assignee: General Dynamics Land Systems—Canada Corporation, Ontario (CA)

( * ) Notice: Subject to any disclaimer, the term of this patent is extended or adjusted under 35 U.S.C. 154(b) by 453 days.

(21) Appl. No.: 12/722,373

(22) Filed: Mar. 11, 2010

(65) Prior Publication Data

US 2011/0168001 A1 Jul. 14, 2011

Related U.S. Application Data

(60) Provisional application No. 61/295,396, filed on Jan. 15, 2010, provisional application No. 61/265,174, filed on Nov. 30, 2009.

(51) Int. Cl.
*F41H 7/02* (2006.01)

(52) U.S. Cl.
USPC ..... 89/36.08; 296/187.08; 296/193.07; 89/36.02

(58) Field of Classification Search
USPC ..... 89/36.07, 36.08, 36.09, 36.01, 36.02; 296/184.1, 187.08, 193.07, 204
See application file for complete search history.

(56) References Cited

U.S. PATENT DOCUMENTS

| | | | | |
|---|---|---|---|---|
| 2,382,862 | A * | 8/1945 | Davis, Jr. | 296/187.07 |
| 6,658,984 | B2 | 12/2003 | Zonack | |
| 6,779,431 | B2 | 8/2004 | Honlinger | |
| 7,228,927 | B2 | 6/2007 | Hass et al. | |
| 7,255,034 | B2 | 8/2007 | Strassgurtl et al. | |
| 7,357,062 | B2 | 4/2008 | Joynt | |
| 7,594,561 | B2 | 9/2009 | Hass et al. | |
| 2006/0201319 | A1 * | 9/2006 | De Wet | 89/36.09 |
| 2007/0186762 | A1 | 8/2007 | Dehart et al. | |
| 2008/0066613 | A1 | 3/2008 | Mills et al. | |
| 2010/0257998 | A1 | 10/2010 | Pavon | |

FOREIGN PATENT DOCUMENTS

| | | |
|---|---|---|
| CA | 2618136 | 2/2007 |
| EP | 0 937 959 | 8/1999 |
| EP | 1574812 | 9/2005 |
| EP | 1821061 | 8/2007 |
| WO | WO 2008/069807 | 6/2008 |
| WO | WO 2008-127272 | 10/2008 |
| WO | WO 2008/127272 | 12/2008 |
| WO | WO 2009-102364 | 8/2009 |
| WO | WO 2009-140331 | 11/2009 |

OTHER PUBLICATIONS

International Search Report and Written Opinion from PCT/CA2011/000046 issued on Apr. 7, 2011.
Canadian American Strategic Review (CASR): Blast Resistant Vehicles—CF Armoured Fighting Vehicles—CF Armoured Fighting Vehicles, Oct. 2006, Webpage can be found at: http://www.casr.ca/id-blast-resistant-vehicles-1.htm.
Howitz, Col. M.C., "The Mine Resistant Ambush Protected Vehicle, A Case Study," USAWC Strategy Research Project (2008).
Kaiser, J.H., "Microwave Evaluation of the Conductive Filler Particles of Carbon Black-Rubber Composites," Applied Physics A: Materials Science and Processing , vol. 56, No. 4 (1993) [Abstract Only].

* cited by examiner

*Primary Examiner* — Gabriel Klein
(74) *Attorney, Agent, or Firm* — Hunton & Williams LLP

(57) ABSTRACT

The present embodiments relate to hull have a geometric shape where a first wall, second wall, and third wall are designed to mitigate the effects of an explosion. In an exemplary embodiment, the hull may have a double-vertex shape.

11 Claims, 8 Drawing Sheets

W-SHAPED HULL

The present invention claims priority to U.S. Provisional Application No. 61/295,396 filed Jan. 15, 2010, and U.S. Provisional Application No. 61/265,174 filed Nov. 30, 2009 the contents of which are incorporated herein by reference in their entireties.

FIELD OF INVENTION

The present embodiments relate, generally, to armored vehicles. More particularly, the present embodiments relate to armored vehicles having a double-vertex shaped hull.

BACKGROUND

Anti-tank mines and improvised explosives are designed to damage or destroy vehicles, including tanks and armored vehicles. Several advances have been made in the development of modern anti-tank mines and improvised explosive devices, increasing the threat these weapons pose to land-fighting forces. The explosives can be hidden anywhere: in potholes, in trash piles, underground, inside of humans and animals. In addition to disguisability, the devices have, over time, become more and more sophisticated with designs enabling them to have more effective explosive payloads, anti-detection and anti-handling features, and more sophisticated fuses.

Many explosive devices are detonated directly underneath or in proximity to armored vehicles. Existing vehicles manufactured with a flat or nearly flat under belly suffer severe damage from such blasts. With flat-bottomed vehicles, the blast effect from an explosive device frequently proves fatal to the vehicle's occupants because of the vertical deflection caused by the blasts. Moreover, sharp angles in the structure of flat-bottomed vehicles such as at the edges of plates result in bending about a localized pivot point during an explosion.

Recognizing these and other problems, manufactures have attempted to develop alternative blast-protection schemes. Many of those alternative schemes have, unfortunately, proven inefficient and unworkable. For example, increasing the thickness of the hull or raising the hull height can improve a vehicle's performance when an explosion occurs. However, these design changes—increasing thickness and raising height—create other problems: they reduce a vehicle's mobility and payload and reduce the available stroke for mitigating the black shock which affects occupant survivability.

These are just a few known problems with existing vehicle designs.

SUMMARY OF THE EMBODIMENTS

In an exemplary embodiment, a structure for the hull of a vehicle is disclosed. The structure comprises a base, two vertex structures, each vertex structure being defined by an inside and outside wall, and a concave structure having at least one substantially flat surface, wherein the concave structure is defined in part by the inside wall of each vertex structure.

In another exemplary embodiment, a structure for a vehicle is disclosed. The structure comprises a first wall being designed to deflect in a direction away from the bottom of the structure, a second wall being designed to deflect in a direction away from the bottom of the structure, and a third wall being designed to deflect in a direction towards the bottom of the structure as a result of the first and second wall deflecting away from the bottom of the structure.

BRIEF DESCRIPTION OF THE DRAWINGS

Advantages of the exemplary embodiments will be apparent to those of ordinary skill in the art from the following detailed description and the accompanying drawings, in which like reference numerals are used to indicate like elements.

DESCRIPTION

The following description conveys an understanding of embodiments that relate generally to vehicles, such as armored vehicles, and more particularly to armored vehicles having blast-resistant features. Blast-resistant features are those that enable a vehicle to mitigate the effects of an explosion. Numerous exemplary embodiments of vehicles having one or more blast-resistant features are described below. Armored vehicles, and other vehicles, described by the exemplary embodiments that have these features are not limited to only those embodiments, however. For example, exemplary embodiments may be used for other types of vehicles or machines outside of the defense industry. The exemplary embodiments may be sized or shaped differently, in any suitable manner, and may be adapted to add components not described, or to remove components that are. One possessing ordinary skill in the art will appreciate the use of the exemplary embodiments for purposes and benefits in alternative forms and industries, depending upon specific design needs and other considerations.

When a blast occurs, an armored vehicle should manage and absorb the energy and impulse generated from a blast and soil ejecta in an effective way. When a blast is managed, a vehicle will adequately mitigate the mine or IED explosion by minimizing excessive damage to the vehicle and substantial injury to the crew. To accomplish this, three primary ways exist to manage the blast energy and impulse that a vehicle experiences during an explosion. First, a vehicle's design should minimize the blast pressure it receives. Second, a vehicle's design should minimize its response to the blast, including minimizing a deflection or rupture response. Third, a vehicle's design should minimize the threat to crew survivability by reducing acceleration and reduce the potential injury of the crew due to the hull's deflection. FIGS. 1-8 illustrate embodiments for vehicles, particularly armored vehicles, that are efficient in mitigating mine or IED blasts in that these embodiments may satisfy one or more of three above-mentioned ways to manage the energy and impulse generated from a blast.

Figure 1:
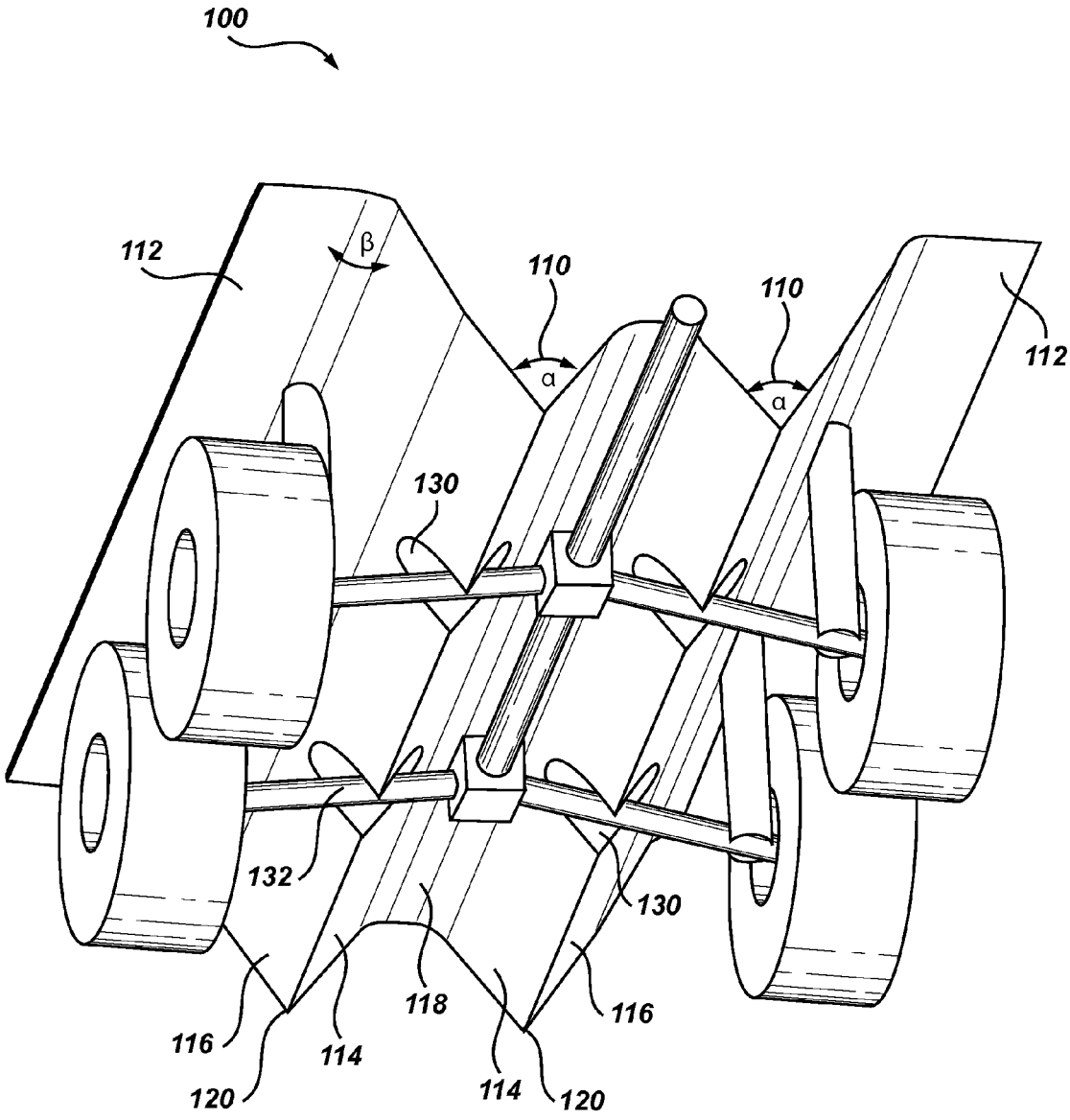
FIG. 1 is a bottom perspective view of a hull for a vehicle, according to one embodiment of the present disclosure.
Figure 2:
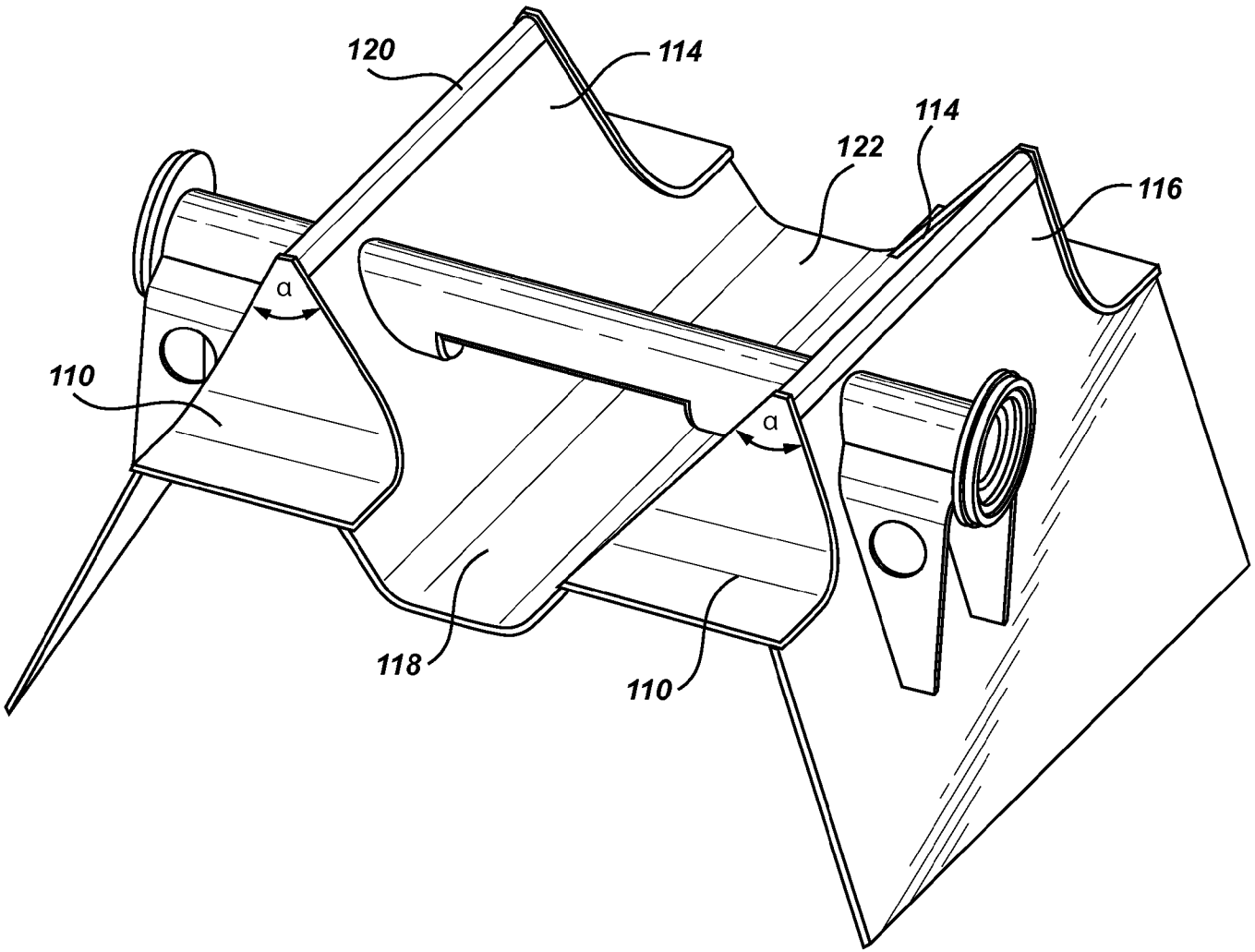
FIG. 2 is a perspective view of an inverted hull for a vehicle, according to one embodiment of the present disclosure.
Figure 3:
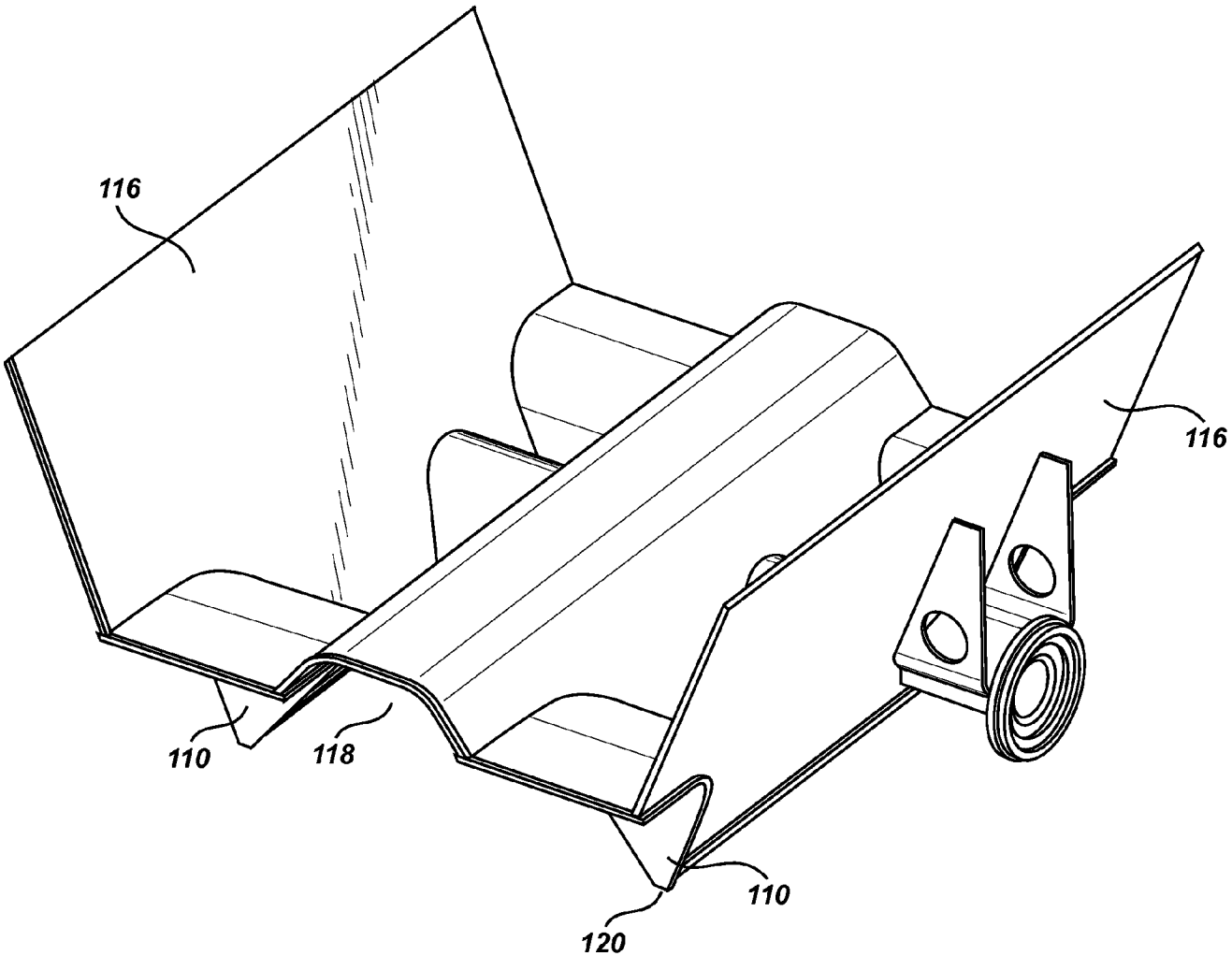
FIG. 3 is a perspective view of a hull for a vehicle, according to one embodiment of the present disclosure.
Figure 4:
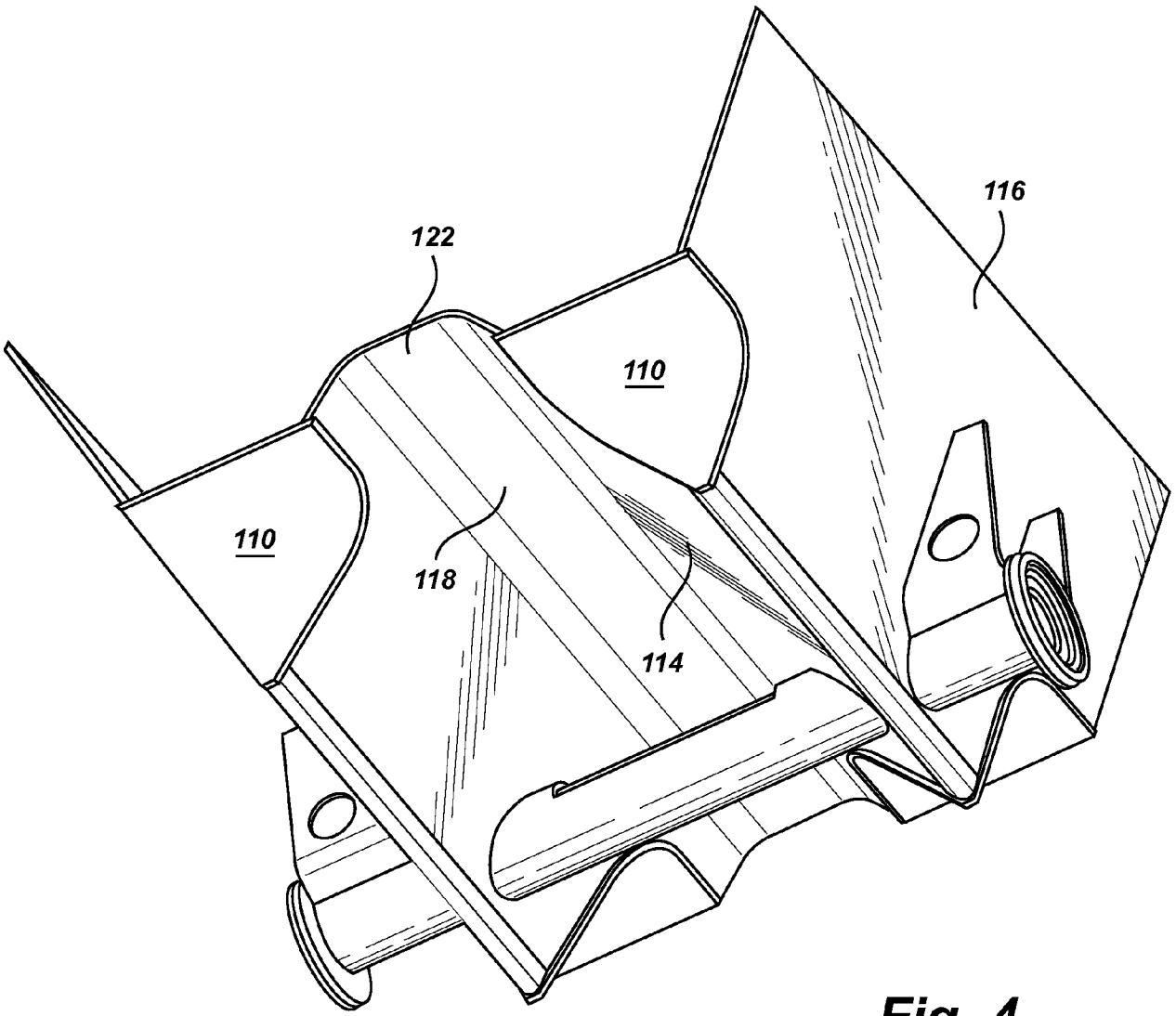
FIG. 4 is a bottom perspective view of a hull for a vehicle, according to one embodiment of the present disclosure.
Figure 5:
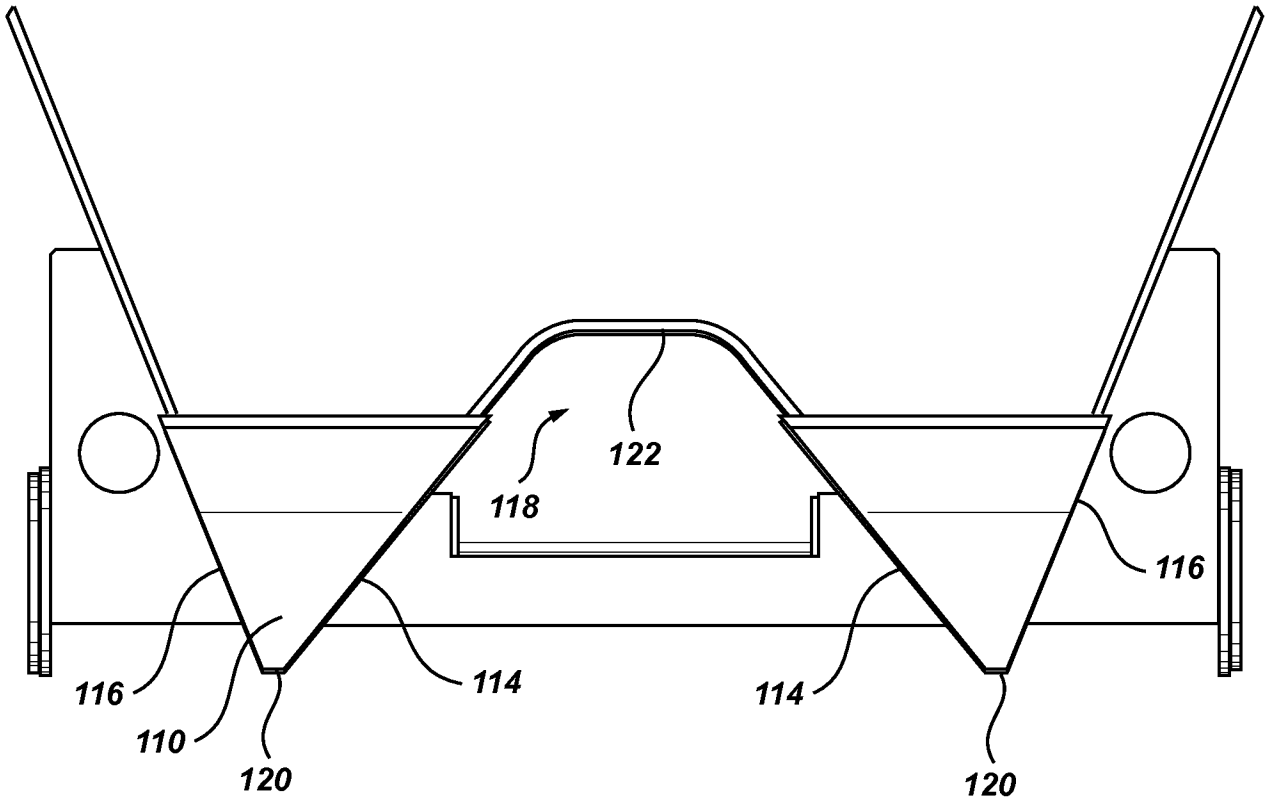
FIG. 5 is a front view of a hull for a vehicle, according to one embodiment of the present disclosure.
Figure 6:
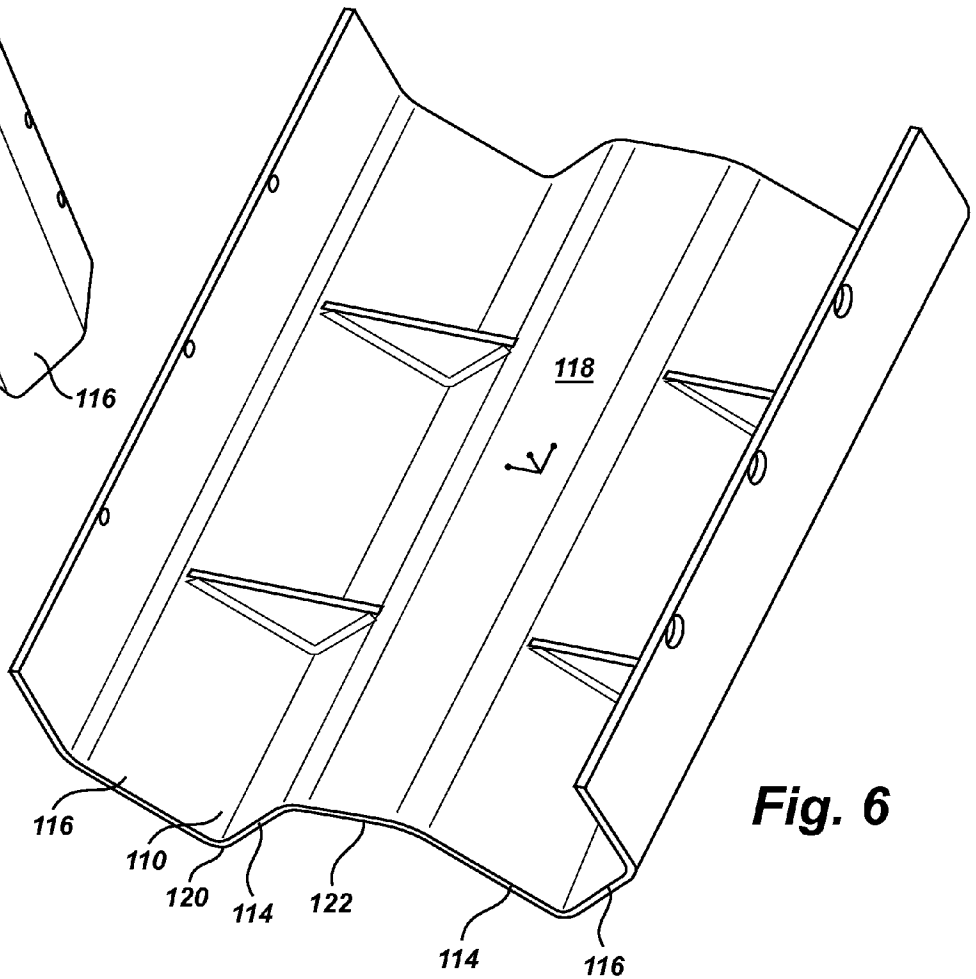
FIGS. 6 and 6*a* are perspective views of a hull for a vehicle, according to another embodiment of the present disclosure.
Figure 6A:
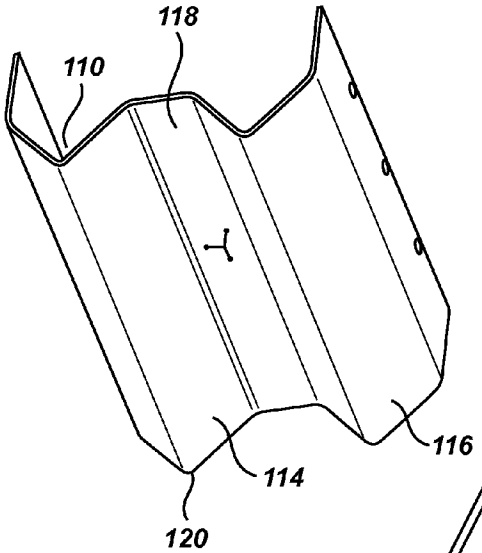

With reference to FIGS. 1-6*a*, a hull 100 for a vehicle, according to an exemplary embodiment, is shown and will be discussed in more detail. FIG. 1 illustrates an exemplary hull 100 for a vehicle, such as an armored vehicle. In an exemplary embodiment, the hull 100 may generally be W-shaped, or alternatively referred to as double-V shaped or double-vertex shaped. In an exemplary embodiment, the hull 100 may comprise two vertex structures 110. Each vertex structure 110 may comprise an inside-inclined wall 114, and an outside-inclined wall 116. In an exemplary embodiment, the inside inclined wall 114 and outside inclined wall 116 may be welded together. Overlaying the weld between walls 114 and walls 116—i.e., covering each vertex structures 110 apex 120—may be a cap that extends run axially along the entire length of each vertex structure 110. If used, the cap may protect the weld to reduce the likelihood the hull 100 may breach at that juncture. A cap may furthermore facilitate proper manufacturing of the hull.

Each vertex structure 110 may extend axially and substantially parallel to the centerline of the hull 100 from the rear of the hull 100 to the front of the hull 100. The two vertex structures 110 may be directed downward such that the apex 120 of each vertex structure 110 will be the lowest point relative to the ground. It should be noted that the hull 100 shown in FIG. 1 may extend axially along the entire length of a vehicle or extend axially along a part of the entire length of a vehicle. In other words, the hull 100 may be used on any vehicle configuration, and one of ordinary of skill in the art can readily determine the appropriate axial length for the hull 100.

The angle $\alpha$ of each vertex structure 110 may be determined based on a particular vehicle configuration and the intended purpose of that vehicle. In an exemplary embodiment, the angle $\alpha$ of each vertex structure 110 may be within a range of 30° to 100° but preferably within 45° to 90°. While these values for angle $\alpha$ are preferable, a double-vertexed hull may be fabricated with any suitable angle $\alpha$ and still maintain the desired structure and function as described herein. In an exemplary embodiment, the angel $\alpha$ for each vertex structure 110 may be substantially equal. Of course, in alternative embodiments, angel $\alpha$ for each vertex structure 110 may be dissimilar.

The angle $\alpha$0 for each vertex structure 110 may influence the maneuverability and blast protection capabilities of a vehicle. For example, a vehicle having a W-shaped hull designed with a narrower angle $\alpha$ will have a higher center of gravity and/or smaller standoff but will better counteract the blast impulse from an explosion. Whereas, a vehicle having a W-shaped hull designed with a wider angel $\alpha$ will have a lower center of gravity and/or higher standoff but will have diminished capabilities to counteract the blast impulse from an explosion. This description is meant only to describe the countervailing factors for W-shaped hulls. However, as stated above, depending on the type of vehicle configuration and its intended purpose, any suitable angle $\alpha$ for each vertex structure 110 may be used.

It should further be noted that designing the hull 100 to have two vertex structures 110, compared to a hull with a single vertex structure, will reduce the vertex angle $\alpha$ by half for a given hull width. This, in turn, will increase the angles of the inclined-inside walls 116 relatively to the hull's vertical axis. These features may result in advantageously increasing the angle of attack between a blast wave and the hull 100, thereby causing a lower received pressure load while simultaneously creating space at the center of the hull 100 (described below) to incorporate the driveshaft and the differentials, which are shown in FIG. 1. The angle of attack between a blast wave and the hull 100 depends on the location of an explosion. For example, if an explosion occurs away from the outside inclined wall 116—between the outside inclined wall 116 and a wheel, for example—the hull 100 still provides advantageous features because it provides for a larger distance between the explosion and the hull 100, which further mitigates the impact of the blast. These and other advantageous features of the W-shaped hull 100 during a blast event will be further explained below.

The W-shaped hull 100, as shown in FIGS. 1-6*a*, may also have a high moment of inertia about the longitudinal axis, and the bending stiffness of the hull 100 may be improved relative to non-W-shaped hull. Specifically, the bending stiffness may be high across the lower structure of the hull 100, resulting in the hull 100 being able to mitigate any localized deformation after an explosion when the blast wave propagates throughout the entire structure of a vehicle. In other words, the W-shaped hull 100 may provide a high-bending stiffness during an explosion about its y-axis. This stiffness may allow for the W-shaped hull 100 to transfer localized deformation energy and momentum from the blast into a global response, thereby reducing localized damage. Quickly and effectively transferring blast energy from a localized area, which is of low mass, to the entire vehicle structure, which is of high mass, may lower the velocity of local plates, thereby reducing damage to the hull 100 while conserving the momentum.

Further, in an exemplary embodiment, the vertex structures 110 may be located approximately at the quarter-line of the hull 100 relative to its width. In some existing vehicles, a hull's quarter-line may be a particularly vulnerable area for a vehicle during an explosion because, typically, there may be a flat horizontal or non-angled plate covering this area of a vehicle. A flat plate may collect a high impulse from the blast and result in high deflection. However, it should be understood that the vertex structures 110 are not limited to being located at the quarter-line of the hull 100 relative to its width. One of ordinary skill in the art can adjust the placement of each vertex structure 110 as necessary and/or desired. That is, in other embodiments, the vertex structures 110 may be located at other places relative to a hull's width and may or may not be symmetric.

In one embodiment, the apex 120 of the vertex structures 110 may generally be between dimensioned and positioned such that a vehicle manufactured or retrofitted with the hull 100 may be able to adeptly traverse and maneuver over terrains likely to be encountered by a vehicle. To achieve this, a vehicle equipped with the W-shaped hull 100 may therefore maintain any suitable ground clearance depending on a vehicle's configuration and intended purpose.

Still referring to FIGS. 1-6*a*, each outside inclined wall 116 extends upwardly from the apex 120 and into a sponson 112. The sponson 112 may form the top portion of the W-shaped hull 110. A transition angle $\beta$ may be formed between each outside inclined wall 116 and each sponson 112. The transition angle $\beta$ may be of any suitable dimension depending on the vehicle configuration. In an exemplary embodiment, transition angle $\beta$ between the outside inclined wall 116 and the sponson 112 may provide for lower deflection. The outside inclined wall 116 and the sponson 112 may be formed from a one-piece construction in an exemplary embodiment but is not limited thereto. That is, a single sheet or plate will be bent to form this lower part of the hull 100, thereby eliminating the potentially vulnerable area between the sponson 112 and the outside inclined walls 116. This type of construction may result in a geometric transition between the sponson 112 and the outside inclined walls 116 potentially able to minimize the stiffness gradient at this location in the hull 100. When the stiffness gradient is minimized, the deformation of the hull 100 may be more uniform and evenly distributed across the area.

In an alternative embodiment, the W-shaped hull 100 may not comprise a sponson 112 while still maintaining the double-vertex shape. Other embodiments for the double-vertex shaped hull 100 are also contemplated herein. For example, the outside inclined wall 116 may be replaced with an entirely vertical wall or be constructed from two or more panels where those panels could be straight, angled, or a combination of both. In other words, the present description contemplates any hull configuration that uses double-vertex shape notwithstanding what the precise dimensions of the panels to form the vertexes.

To complete the W-shaped hull structure, the hull 100 may comprise a concave structure 118. The concave structure 118 may be located between the two vertex structures 110. Still referring to FIGS. 1-6*a*, which illustrates an inverted W-shaped hull, the concave structure 118 may be formed by the two inside-inclined walls 114 and have a substantially flat surface 122. The concave structure 118, like the two vertex structures 110, may extend axially from a front portion of the hull 100 to a back portion, with the centerline of the concave structure 118 being coplanar with the centerline of the hull 100, in one embodiment. In alternative embodiments, the concave structure 118 may extend along the entire axial length of a vehicle or only along a portion of the axial length. In an exemplary embodiment, the concave structure 118 may maintain a necessary ground clearance depending on the vehicles configuration and its intended purpose.

As discussed above and as shown in FIG. 1, the concave structure 118 may create a space for other vehicles components, including the driveshaft and differentials. Creating a space for vehicles components may also provide desired access to a vehicle's mechanical components for desired maintenance. In addition, these mechanical components may be designed not to impact the hull 100 during a blast event. In an alternative embodiment, the concave structure 118 may comprise multi-part piece having one or more panels, although a single piece construction is preferred. The concave structure 118 may also be layered with another protective panel or other blast-resistant features.

Referring to FIG. 1, the hull 100 may comprise one or more notches 130, depending on the number of wheels a particularly vehicle might have. In an exemplary embodiment, each of the vertex structures 110 may have a plurality of notches 130 to accommodate the wheel axles 132. Wheels may be mounted onto a single axle that extends across the full width of the hull 100 and through the notches 130 in the vertex structures 110. An axle may be any suitable shape and mounted in any suitable way. Further, one of ordinary skill in the art can determine the appropriate suspension system to use based on the vehicle configuration.

Various materials can be used for the hull 100 and its components, depending on system requirements on space claim, weight impact, budget-cost constraints, and manufacturing techniques and equipment. Possible, non-limiting materials that can be used for the hull 100 and its components include steel, aluminum, titanium, ballistic steel, ballistic aluminum, ballistic titanium, composites, and so on, or a combination of materials. Moreover, the thickness of the hull 100 can vary as necessary and/or desired.

Figure 8:
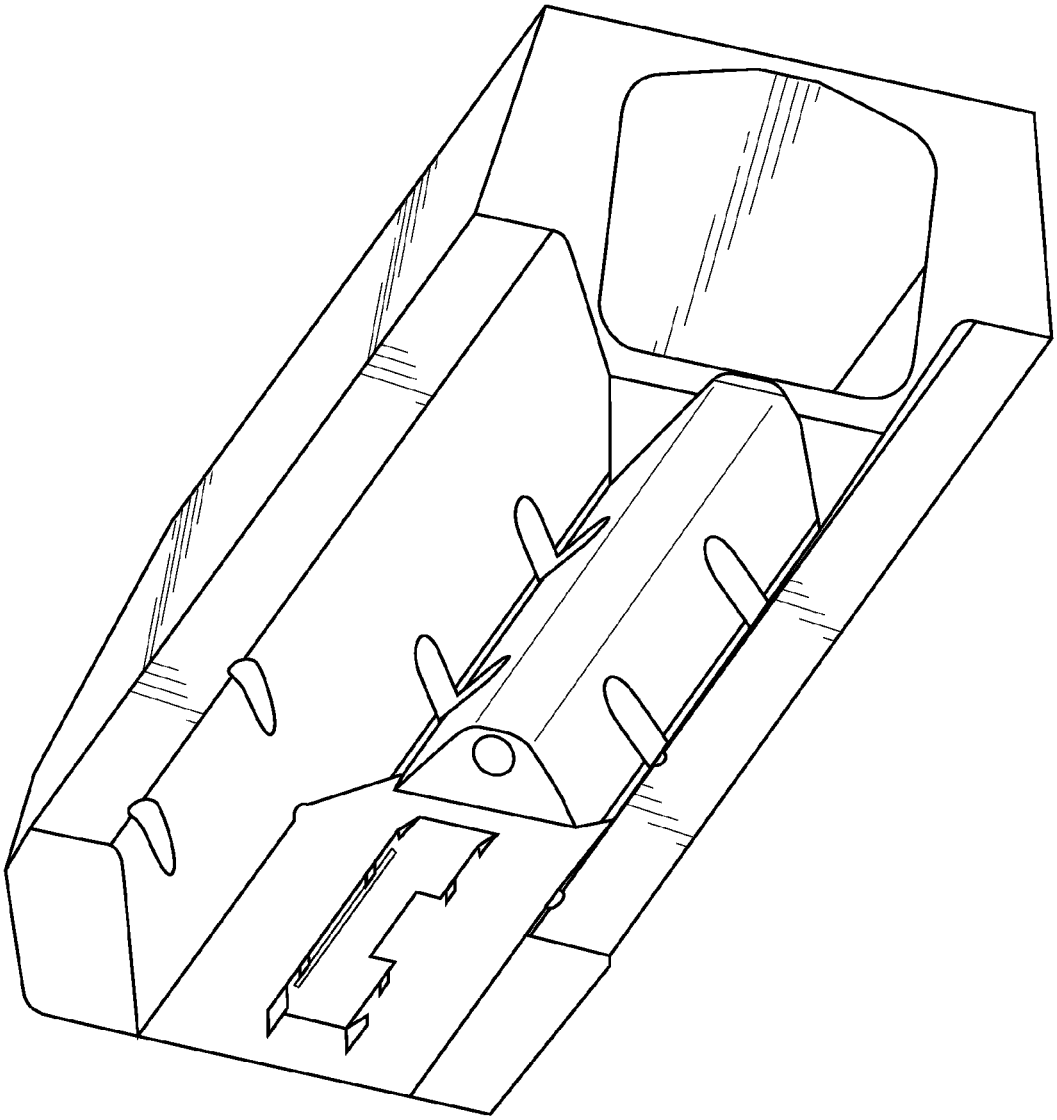
FIG. 8 is a perspective view of a body for a vehicle, according to one embodiment of the present disclosure.

Furthermore, the hull 100 can be designed and dimensioned for a variety of wheeled vehicles, including High Speed, Agile Light Vehicles; Wheeled Combat and Derivative Vehicles; Medium Transport & Support Vehicles; Heavy Transport Vehicles; and Tank Transporters. These vehicles may be 4×4, 6×6, or 8×8 wheeled vehicles, or have any other wheel configuration. The hull 100 may also be used for vehicles driven by tracks, or a combination of wheels and tracks. FIG. 8 shows an exemplary embodiment of a vehicle having a W-shaped hull. The depicted vehicle may be a full-time four-wheel drive, selectively eight-wheel drive, light-armored vehicle. The vehicle may provide for armored protection of the crew. The W-shaped hull 100 may extend along the entire length of a vehicle or only along an intermediate length, which will be described in more detail below. The hull 100 may generally be symmetric about the longitudinal centerline of the vehicle.

It will be understood, of course, that the foregoing hull arrangement may be modified or altered in any number of ways, and various parts may be omitted or added in other embodiments.

Figure 7:
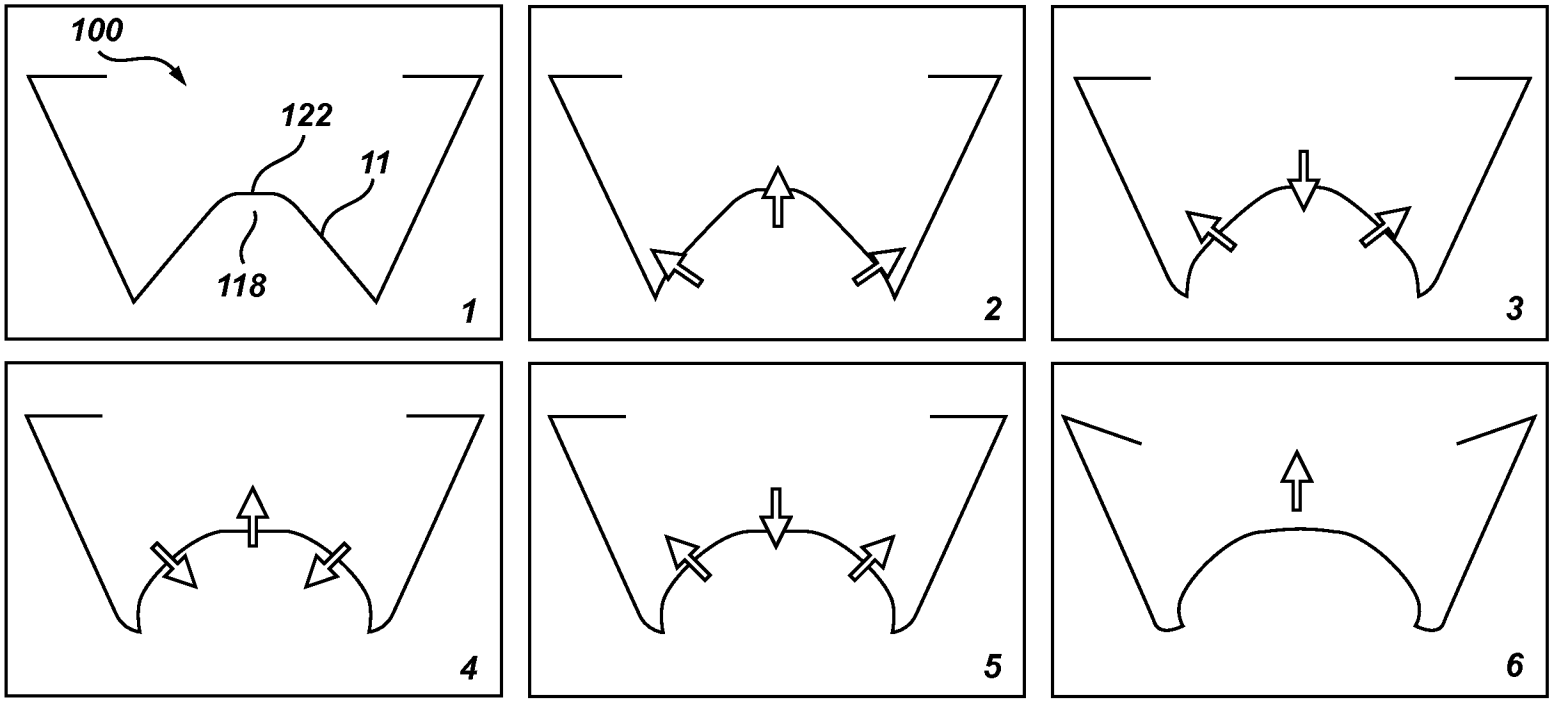
FIG. 7 is an illustration of the Lee Effect for a hull for a vehicle, according to another embodiment of the present disclosure.

As mentioned above, the W-shaped hull 100 may provide efficient mine-blast protection for a vehicle, without significantly impacting the vehicle's weight. Referring to FIG. 7, the W-shaped hull 100 may create a controlled directional deformation at a specific location on the hull 100 due to the hull's geometric attributes. Specifically, when an explosion occurs underneath a vehicle, a downward force may be produced on the surface 122 of the concave structure 118, which may be a critical area for a vehicle because a vehicle's crew may sit directly above that location—i.e., the crew's feet may be positioned close to the hull's floor at that location. This downward force may counteract any upward deformation induced by the blast pressure. By counteracting upward deformation, the hull 100 may be able to mitigate vertical deflection.

This phenomenon exhibited by the hull 100 during a blast may be referred to as the Lee Effect. Generally, the Lee Effect is a blast-deformation technique that relies on a structure's geometric properties. The W-shaped hull is an example of one such structure that uses the Lee Effect. Overall, the Lee Effect describes a structure using its own geometric attributes to create a downward force by depending on the lateral deformation induced by a blast on a connected part of the structure to counteract any vertical upward deflection caused by a blast-type load.

Explained in more detail, when a blast even occurs at or near the center of the hull 100, the blast shockwave and debris will first impact the inclined-inside walls 114 of the hull 100 structure first, pushing the inclined-inside walls 114 away in a direction that is normal to the plate. The shockwave and debris will next impact the substantially flat surface 122 of the concave structure 118 because of its distance from the explosive device. Predictably, the surface 122 of the concave structure 118 will receive an upward force induced by the pressure, debris, and shockwave. But, as the inclined-inside walls 114 of the hull 100 begin to deform at a direction normal to their surfaces, a horizontal deformation component may be created. This horizontal deformation component may create a downward force on the substantially flat surface 122 of the concave structure 118—in part because these structures are connected structures and have a tendency to conserve volume—pulling the substantially flat surface 122 downward. This downward action caused by the horizontal deformation component counteracts the upward force being exhibited on the surface 122 of the concave structure 118. This counteraction mitigates any vertical deflection of the concave structure 118, reducing the injury to a crew when a blast event occurs. In addition, as the inclined-inside walls 114 deform, kinetic energy from the blast is transformed into strain energy of the material in the hull 100, thus reducing any energy that is available to deform the plate and accelerate the hull 100. It should be noted that some elastic recovery occurs at the deformed surfaces, which causes the inclined-inside walls 114 and the concave structure 118 to vibrate in a cyclic, synchronized manner.

As mentioned in the preceding paragraph and as illustrated in FIG. 7, the hull 100 initially deforms at the inclined-inside walls 114 of the hull 100. This deformation, however, occurs underneath the crew floor and generally consists of lateral deformation and not vertical deformation. Therefore, the impact to the crew floor or the crew may be minimized. In addition, as the inclined-inside walls 114 are deforming, the blast energy received by the hull 100 may be transferred into strain energy, thus reducing the available energy for global vehicle motion. As a result, the available energy associated with the acceleration of the vehicle and its crews is minimized. This will significantly reduce the Dynamic Response Index (DRI) value, hence improving crew survivability.

The W-shaped hull is also designed to mitigate a blast if an explosive device is detonated between the centerline of the hull 100 and one of the outside inclined walls 116. Most current vehicles, that do not have a W-shaped hull, are vulnerable when a blast occurs at or near the quarter-line of the hull 100. As discussed above, the vertex structures 110 of the W-shaped hull are located at or near the quarter-line of the hull 100. Thus, if an explosion occurs underneath this quarter-line location, the average angle of attack between the shock wave and the hull 100 may be maximized, which will reduce the pressure load on all surfaces of the hull 100. In addition to the sharp angle of the vertex structures 110, the hull 100 may have a heightened stiffness at the vertex structures 110, further mitigating vertical deformation.

Referring back to FIGS. 1-6*a*, a crew floor (not shown) will be mounted inside of a vehicle and above the hull 100. The floor may run horizontal to the concave structure 118 of the hull 100. The floor may comprise any additional blast-resistant features, which further protect a crew during an explosion. Such additional blast-resistant features are known in the art. The floor may be mounted inside of the hull 100 in suitable way, as is known in the art. Having the floor install above and inside of the hull 100, it may impede any secondary projectiles that penetrate the hull 100 during an explosion. An exemplary floor may comprise a multi-part structure having a frame and one or more layers.

The figures and description depict and describe exemplary embodiments of a vehicle with features capable of better protecting a vehicle when subjected to an explosion. As used throughout this description, the term "vehicle" or "armored vehicle" or other like terms is meant to encompass any vessel designed with the features described herein. For example, it is meant to encompass any type of military vehicle regardless of its weight classification. Furthermore, the exemplary embodiments may also be used for any vehicle or machine, regardless of whether they are specifically designed for military use. The vehicles are not limited to any specific embodiment or detail that is disclosed.

The terminology used in this description is for describing particular embodiments only. It is not intended to limit the scope of an exemplary embodiment. As used throughout this disclosure, the singular forms "a," "an," and "the" include the plural, unless the context clearly dictates otherwise. Thus, for example, a reference to "an axle" includes a plurality of axles, or other equivalents or variations known to those skilled in the art. Furthermore, if in describing some embodiments or features permissive language (e.g., "may") is used, that does not suggest that embodiments or features described using other language (e.g., "is," "are") are required. Unless defined otherwise, all terms have the same commonly understood meaning that one of ordinary skill in the art to which these embodiments belong would expect them to have.

With regard to the exemplary embodiments of the vehicle described above, any part that fastens, joins, attaches, or connects any component to or from the vehicle is not limited to any particular type and is instead intended to encompass all known and conventional fasteners, like screws, nut and bolt connectors, threaded connectors, snap rings, detent arrangements, clamps, rivets, toggles, and so on. Fastening may also be accomplished by other known fitments, like welding, bolting, or sealing devices. Components may also be connected by adhesives, polymers, copolymers, glues, ultrasonic welding, friction stir welding, and friction fitting or deformation. Any combination of these fitment systems can be used.

Unless otherwise specifically disclosed, materials for making components of the present embodiments may be selected from appropriate materials, such as metal, metal alloys, ballistic metals, ballistic metal alloys, composites, plastics, and so on. Any and all appropriate manufacturing or production methods, such as casting, pressing, extruding, molding, machining, may be used to construct the exemplary embodiments or their components.

When describing exemplary embodiments, any reference to relative position—front and back, or rear, top and bottom, right and left, upper and lower, and so on—is intended to conveniently describe those embodiments only. Positional and spacial references do not limit the exemplary embodiments or its components to any specific position or orientation.

What is claimed is:

1. A blast-resistant structure for the hull of a land vehicle, the structure comprising:

a base, comprising:

two vertex structures, each vertex structure being defined by an inwardly inclined inside wall connected to an outwardly inclined outside wall at a vertex; and a concave structure having at least one substantially flat surface;

wherein the concave structure is supported by the two vertex structures and is positioned laterally intermediate the two vertexes, is concave in a downward direction and has outer portions defined in part by the inside wall of each vertex structure, the outer portions being connected by the at least one substantially flat surface, wherein the base has a constant cross-section along a longitudinal length of at least a portion of the vehicle where blast protection is required, wherein the base, when subjected to an explosion between the two vertex structures, deforms along at least one of the inside walls to create a downward force on the at least one substantially flat surface of the concave structure, and wherein at least a portion of the concave structure is higher than an axle of the vehicle and the vertexes of the vertex structures are lower than the axle of the vehicle.

2. The structure of claim 1, wherein the downward force created by the deformation of the inside wall counteracts an upward force from the explosion on the concave structure.

3. The structure of claim 1, wherein the two vertex structures each have an apex angle in a range of 30° to 110°.

4. The structure of claim 1, wherein the outwardly inclined outside walls each have an outward end, a distance between the outward ends defining a hull width, and wherein each vertex is spaced inwardly from a respective one of the outward ends.

5. The structure of claim 1, wherein the concave structure is configured and dimensioned to receive a driveshaft and one or more differentials of the vehicle.

6. The structure of claim 1, wherein a floor is disposed inside of the structure above the concave structure.

7. The structure of claim 1, wherein the hull comprises steel, ballistic steel, metal alloy, or ballistic metal alloy, or a combination thereof.

8. The structure of claim 1, wherein the two vertex structures each have an apex angle in a range of 45° to 90°.

9. The structure of claim 1 wherein the vertex structures each comprise a notch configured to receive a portion of the axle and to allow the axle to pass from one side of the vehicle to the other.

10. The structure of claim 4, wherein each vertex is spaced inwardly from a respective one of the outward ends by a distance equal to one quarter of the hull width.

11. The structure of claim 1, wherein the inside wall of each vertex structure is welded to the outside wall of the vertex structure at the vertex along an axial length of the vehicle and wherein the structure further comprises a cap overlying the weld, the cap extending along the entire axial length of the weld.

* * * * *

UNITED STATES PATENT AND TRADEMARK OFFICE

CERTIFICATE OF CORRECTION

PATENT NO. : 8,499,677 B2
APPLICATION NO. : 12/722373
DATED : August 6, 2013
INVENTOR(S) : Lee It is certified that error appears in the above-identified patent and that said Letters Patent is hereby corrected as shown below:

Title Page, item (57), should read,

(57) ABSTRACT

The present embodiments relate to hulls having a geometric shape where a first wall, second wall, and third wall are designed to mitigate the effects of an explosion. In an exemplary embodiment, the hull may have a double-vertex shape.

Signed and Sealed this
Eighth Day of October, 2013

Teresa Stanek Rea

Teresa Stanek Rea
*Deputy Director of the United States Patent and Trademark Office*